United States Patent [19]

Seragnoli

[11] 4,433,694

[45] Feb. 28, 1984

[54] DEVICE FOR APPLYING FILTERS TO CIGARETTES

[75] Inventor: Enzo Seragnoli, Bologna, Italy

[73] Assignee: G. D Societa per Azioni, Bologna, Italy

[21] Appl. No.: 309,162

[22] Filed: Oct. 6, 1981

[30] Foreign Application Priority Data

Nov. 17, 1980 [IT] Italy ..... 50175 A/80

[51] Int. Cl.[3] ..... A24C 5/47

[52] U.S. Cl. ..... 131/92; 131/95

[58] Field of Search ..... 131/94, 95, 90, 91, 131/92, 93

[56] References Cited

U.S. PATENT DOCUMENTS 3,363,632 1/1968 Gamberini ..... 131/94

3,933,159 1/1976 Molins ..... 131/94

*Primary Examiner*—V. Millin

*Attorney, Agent, or Firm*—Fitzpatrick, Cella, Harper & Scinto

[57] ABSTRACT

A device for applying filters to cigarettes by means of adhesive connection bands of a type comprising a peripherally grooved conveyor roller which transfers to a position, referred to as rolling position, units comprising two axially aligned cigarettes with the interposition of a filter section. At the rolling position an element, referred to as counter-rolling element, defines in combination with said conveyor roller a passage at which said bands are rolled up about the units. By means of a cutting device cooperating with said conveyor roller, the bands are provided by a paper web fed from a reel.

After receiving adhesive on one face by a gluing device and before reaching the conveyor roller, said web skirts the surface of a heated rotating roller which causes the partial evaporation of the solvent in the adhesive.

2 Claims, 1 Drawing Figure

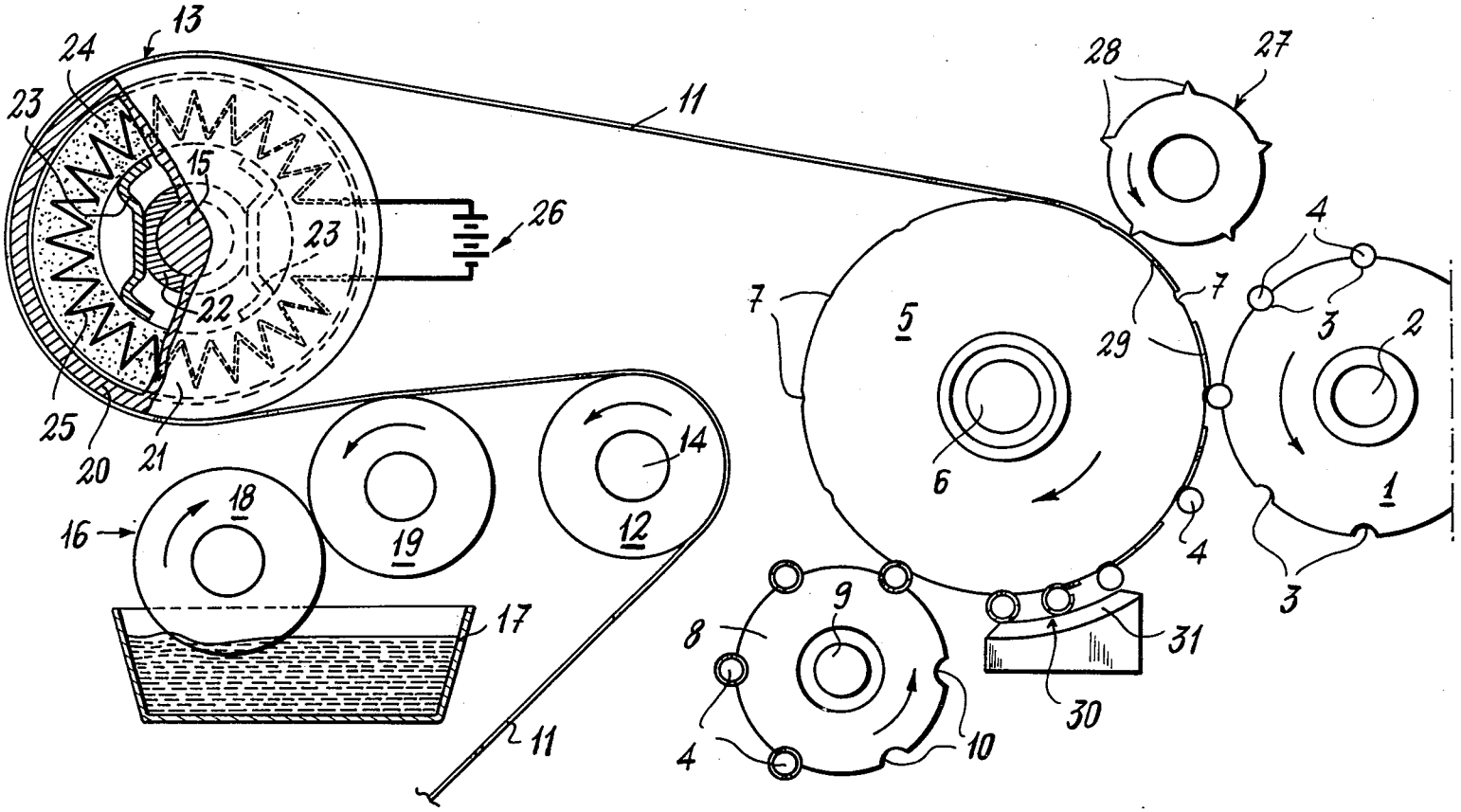
1
2
3
4
5
6
7
8
9
10
11
12
13
14
15
16
17
18
19
20
21
22
23
24
25
26
27
28
29
30
31

DEVICE FOR APPLYING FILTERS TO CIGARETTES

BACKGROUND OF THE INVENTION

This invention relates to a device for applying filters to cigarettes, and, more particularly, a device in which the cigarettes and filters are interconnected by adhesive connection bands.

As already known, the application of filters to cigarettes is usually accomplished by so-called filter-applying machines according to the steps briefly described thereinafter.

The cigarettes are placed, two by two, in axial alignment. Between two cigarettes in axial alignment and in contact with the ends thereof a filter section of twice a length as that of a single cigarette is placed. The assembly or unit comprising the two cigarettes and said section is connected by an adhesive band of paper material, wrapped up to cover the filter section and each of said ends for a length of about ⅛". The operations shown are usually carried out while cigarettes and filter sections are retained by suction by the periphery of a longitudinally splined rotating rolling drum.

A fixed concave plate, coaxial with said drum and spaced apart therefrom by a distance substantially equal to the diameter of a cigarette, frictionally engages said units, causing them to roll on the bands, with the latter wrapping up thereabout and connecting the elements thereof.

In the devices of the above described type, said bands are usually provided from a web unwound from a reel, to which a device applies adhesive onto a face prior to cutting.

Due to the very high operating speed attained by modern filter-applying machines, the glue or adhesive on the bands can not sufficiently dry during the short rolling period of said units, where the evaporation of the solvent therein should not be accelerated.

Devices are known in which such a result is achieved by heating said rolling drum, according to the teachings disclosed, for example, in the Italian Pat. No. 697,843, or said fixed plate (German Pat. No. 1,881,457). Both of such devices have disadvantages arising in that, due to the shortness of rolling operation, a sufficient drying of the glue or adhesive can be provided only by extending said rolling beyond the least amount essential for the band wrapping up and/or by using heating means of considerable power.

These expedients may cause damage to the cigarettes since the heating thereof, although limited as far as possible to the filter zone as described in said Italian Pat. No. 697,843, may alter the tobacco quality. In addition, the continued rolling may easily cause tobacco particles to move out of the cigarette ends.

In other known devices, of which one is described for example in U.S. Pat. No. 3,420,243, the heating element comprises a roller operating in combination with a rotary knife to divide the web into bands. A disadvantage of these devices resides in that, due to thermal expansions changing the dimensions of said roller at different operating times of the filter-applying machine, said rotary knife is uncapable of constantly, regularly operating on the web. Then, also any thermal deformation of said roller would adversely affect the cut of the bands.

SUMMARY OF THE INVENTION

An object of the present invention is to provide a device for applying filters to cigarettes, which can ensure a perfect connection between the elements by adhesive connection bands, without having the described disadvantages of the known devices.

This and still other objects have been accomplished by the device for applying filters to cigarettes by connection bands, comprising a gluing device for applying adhesive material to a web, transfer rollers for said web from said gluing device to a position of application of the filters to the cigarettes, defined by one of said rollers referred to as rolling drum, in combination with a reaction or counter-rolling element, a rotary knife cooperating with one of said rollers, referred to as cutting roller, for dividing said web into sections or bands, said device being characterized in that at least one of said rollers, referred to as drying roller, distinct from said cutting roller and located upstream of said rolling drum relative to the web feeding direction, is heated.

The novel features which are considered as characteristic of the invention are set forth in particular in the appended claims. The device itself, however, both as to its construction and its mode of operation, together with additional features and advantages thereof, will be better understood upon perusal of the following detailed description of a preferred embodiment with reference to the accompanying drawing.

DESCRIPTION OF THE DRAWING

The FIGURE shows a schematic front view of the device according to the invention.

BRIEF DESCRIPTION OF THE PREFERRED EMBODIMENTS

Referring to said FIGURE, reference numeral 1 denotes a roller or drum having a horizontal axis, which is carried by a shaft 2 and rotatably driven by means, not shown, in counterclockwise direction. On its periphery such a roller 1 is provided with equispaced apart longitudinal splines or grooves 3, in which units of the above described type are retained by suction. Such units are indicated as a whole by reference numeral 4 and comprise two cigarettes with the interposition of a filter section of twice a length as that of the filter to be applied to a single cigarette.

Adjacent said roller 1 and at the left side in the drawing, a roller or drum 5 is provided, carried by a shaft 6 parallel to said shaft 2.

This roller 5 is peripherally provided with equally spaced apart sucking grooves 7, and clockwise rotates with the same peripheral speed as that of roller 1, successively matching its grooves 7 with said grooves 3.

Reference numeral 8 denotes a roller having a horizontal axis, carried by a shaft 9 adjacent the left lower zone of roller 5.

This roller 8 is peripherally provided with sucking grooves 10, which are equally spaced apart from one another according to the same pitch as that of grooves 3 and 7. Said roller rotates in counterclockwise direction with the same peripheral speed as that of roller 5, and successively matches its grooves 10 with grooves 7.

A web 11 of paper material fed from a reel, not shown in the drawing, is tangentially supplied on the periphery of roller 5. Sucking means, not shown, terminating in apertures, not shown, on the surface of roller 5, would maintain said web adhering to roller 5.

Before coming into contact with roller 5, said web 11 skirts a transmission roller 12 and a drying roller 13, as discussed later herein, rotating about respective shafts 14 and 15 parallel to shaft 6.

Between said rollers 12 and 13, said web 11 grazes a gluing device, indicated as a whole at 16. This device 16, which may be of any type, in the present example substantially comprises a glue or adhesive basin 17, a rotating roller 18 partly immersed in said basin 17, and a roller 19 tangent to roller 18, having the task of withdrawing the glue or adhesive from the periphery of the latter to transfer it onto one face of web 11.

Said drying roller 13 substantially comprises a hollow cylinder 20 which on the front base is defined by a wall 21 integral with shaft 15.

This shaft 15 passes through a sleeve 22, forming part of the bedplate of the filter-applying machine, which by means of brackets 23 supports an annular element 24 within the hollow cylinder 20 and adjacent the inner surface of the latter.

An electric heating means or resistance 25 is accommodated within said annular element 24 and terminates at a current generator 26.

Upstream of the proximity zone between said rollers 1 and 5, said web 11 is acted upon by a cutting means or rotary knife 27, which is peripherally provided with five equally spaced apart blades 28 cooperating in the cutting action with said roller 5.

Such a knife 27 rotates in counterclockwise direction and from said web 11 successively separates bands 29 intended to interconnect the elements of units 4.

The peripheral speed of roller 5 is higher than the feeding speed of web 11, and the initial edge of the latter constantly slides on roller 5, so that after the cut said bands 29 will adhere to said roller 5 as conveniently spaced apart from one another.

At a position referred to as rolling position and indicated at 30, located adjacent the roller 5 between said rollers 1 and 8, the bedplate of the filter-applying machine supports, in a manner not shown, a concave plate or counter-rolling element 31, which is coaxial with said roller 5 and spaced apart therefrom by a distance of nearly about the diameter of a unit 4.

In operation, the units 4 are successively transferred from the grooves 3 of roller 1 to the grooves 7 of roller 5. The bands 29, which are maintained by suction adhering to roller 5, are each between two successive grooves 7, and have their front edge approaching the downstream located groove 7, the front edge being referred to as the direction of rotation of roller 5.

On reaching the rolling position 30, said units 4 are frictionally engaged by the so-called counter-rolling surface of plate 31 and roll on the relative bands 29, wrapping up thereabout and connecting the elements thereof.

During such a rolling, each of said units 4 move out of the respective groove 7, which should be of highly limited depth and, at the end of operation, would then re-enter the successive groove 7. After the described rolling, the units 4 reach said roller 8 which is provided to accomodate them in grooves 10 and leads them to stations of subsequent processing, not shown.

According to an important feature of the present invention, after receiving the adhesive from the gluing device 16 and before reaching the roller 5, the web 11 is conveniently heated by the roller 13 to almost or nearly complete drying of the glue or adhesive thereon.

Upon such a preheating, the adhesive applied to the bands has during the rolling step sufficient cohesion to ensure a regular connection of units 4, but is almost dry as not to require any further drying at the end of rolling. Of course, still under the principle of this invention, there are many changes that can be made to the device which is described by way of unrestrictive example, without departing from the scope of the present invention.

For example, when the cut of web 11 is carried out by knife 27 in cooperation with a reaction or cutting roller other than roller 5, located upstream of the latter, the heated roller 13 could be located downstream of the cutting zone of bands 29, and act as a connection between such rollers. In this case, both the heated roller 13 and the roller cooperating with knife 27 should be peripherally perforated and terminate in a suction source, so as to maintain said web 11 and bands 29 adhering to the surface thereof.

What I claim is:

1. A device for applying filters to cigarettes by connection bands, comprising:

a gluing device for applying adhesive material to a web;

means for moving the web from said gluing device to a position for adhering filters to cigarettes, defined by a rolling drum in combination with a counter-rolling element;

a cutting roller positioned adjacent the rolling drum to act therewith but before the rolling drum acts in combination with the counter-rolling element, for cutting the web into a plurality of bands; and a drying roller positioned between said gluing device and said cutting roller, for almost drying the adhesive material on the web so that when the banded filters and cigarettes leave the adhering position the adhesive material on the band is dry.

2. A device according to claim 1, wherein said drying roller is heated by stationary electric means associated therewith.

* * * * *